US009643042B2

(12) United States Patent
Madden

(10) Patent No.: US 9,643,042 B2
(45) Date of Patent: May 9, 2017

(54) FREESTANDING SELECTABLE FREE WEIGHT ASSEMBLY

(71) Applicant: Vintage Gold Holdings Limited, Causeway Bay (HK)

(72) Inventor: Marshall Madden, Springfield, MO (US)

(73) Assignee: Vintage Gold Holdings Limited, North Point (HK)

( * ) Notice: Subject to any disclaimer, the term of this patent is extended or adjusted under 35 U.S.C. 154(b) by 0 days.

(21) Appl. No.: 14/438,111

(22) PCT Filed: Oct. 26, 2012

(86) PCT No.: PCT/US2012/062289
§ 371 (c)(1),
(2) Date: Apr. 23, 2015

(87) PCT Pub. No.: WO2014/065827
PCT Pub. Date: May 1, 2014

(65) Prior Publication Data

US 2015/0297936 A1 Oct. 22, 2015

(51) Int. Cl.
*A63B 21/075* (2006.01)
*A63B 21/072* (2006.01)
(Continued)

(52) U.S. Cl.
CPC ..... *A63B 21/075* (2013.01); *A63B 21/00065* (2013.01); *A63B 21/063* (2015.10);
(Continued)

(58) Field of Classification Search
CPC ..... A63B 21/0004; A63B 21/00061; A63B 21/00065; A63B 21/00069;
(Continued)

(56) References Cited

U.S. PATENT DOCUMENTS 5,346,448 A 9/1994 Sollo
5,637,064 A * 6/1997 Olson ..... A63B 21/0728 482/107
(Continued)

FOREIGN PATENT DOCUMENTS

WO 2012058612 A1 5/2012

OTHER PUBLICATIONS

International Search Report and Written Opinion for corresponding PCT Application No. PCT/US2012/062289 dated Jan. 8, 2013, 8 pages.

*Primary Examiner* — Loan H Thanh
*Assistant Examiner* — Gary D Urbiel Goldner
(74) *Attorney, Agent, or Firm* — Senniger Powers LLP

(57) ABSTRACT

A weight plate for use in an adjustable weight set includes a weight plate member having a plate surface. A locking mechanism on the weight plate member secures the weight plate to another weight plate of the set. The locking mechanism comprises a plurality of spaced apart locking elements each being formed by at least one cut in the weight plate member. At least a portion of each locking element is displaced from the plate surface forming a slot behind the locking element. The slot receives a locking element on another weight plate of the set to secure the weight plate to the other weight plate. The locking elements are arranged relative to each other and to a centrally disposed hole in the weight plate for securely retaining the weight plate and the weight plates to each other.

10 Claims, 22 Drawing Sheets

(51) Int. Cl.
*A63B 21/00* (2006.01)
*A63B 21/062* (2006.01)
*A63B 23/12* (2006.01)

(52) U.S. Cl.
CPC ..... *A63B 21/0726* (2013.01); *A63B 21/0728* (2013.01); *A63B 21/1469* (2013.01); *A63B 23/12* (2013.01)

(58) Field of Classification Search
CPC ..... A63B 21/00072; A63B 21/062; A63B 21/0622; A63B 21/0624; A63B 21/0626; A63B 21/0628; A63B 21/063; A63B 21/0632; A63B 21/072; A63B 21/0722; A63B 21/0724; A63B 21/0726; A63B 21/0728; A63B 21/075; A63B 21/08; A63B 21/159; A63B 21/4023; A63B 21/4033; A63B 21/4035; A63B 21/4043; A63B 23/12; A63B 23/1209; A63B 23/1245; A63B 23/1281; A63B 23/14; A63B 2225/09
See application file for complete search history.

(56) References Cited

U.S. PATENT DOCUMENTS

| | | | | |
|---|---|---|---|---|
| 5,769,762 | A | 6/1998 | Towley, III et al. | |
| 6,083,144 | A | 7/2000 | Towley, III et al. | |
| 6,149,558 | A | 11/2000 | Chen | |
| 6,196,952 | B1 | 3/2001 | Chen | |
| 6,228,003 | B1 | 5/2001 | Hald et al. | |
| 6,261,022 | B1 | 7/2001 | Dalebout et al. | |
| 6,500,101 | B1 | 12/2002 | Chen | |
| 6,540,650 | B1 | 4/2003 | Krull | |
| 6,758,795 | B2 | 7/2004 | Barber | |
| 7,060,011 | B1 * | 6/2006 | Krull | A63B 21/0728 482/107 |
| 7,090,625 | B2 | 8/2006 | Chermack | |
| 7,153,244 | B2 | 12/2006 | Towley, III et al. | |
| 7,264,578 | B1 | 9/2007 | Krull | |
| 7,335,142 | B2 | 2/2008 | Towley, III et al. | |
| 7,377,885 | B2 | 5/2008 | Doudiet | |
| 7,387,596 | B2 | 6/2008 | Towley, III et al. | |
| 7,491,155 | B2 | 2/2009 | Fenelon et al. | |
| 7,497,814 | B1 | 3/2009 | Krull | |
| 7,520,845 | B2 | 4/2009 | Towley, III et al. | |
| 7,547,268 | B1 | 6/2009 | Krull | |
| 7,578,772 | B2 | 8/2009 | Lippitt | |
| 7,611,448 | B2 | 11/2009 | Schiff | |
| 7,621,855 | B1 | 11/2009 | Krull | |
| 7,862,487 | B2 | 1/2011 | Olson | |
| 8,007,415 | B1 | 8/2011 | Lundquist | |
| 2002/0115539 | A1 * | 8/2002 | Krull | A63B 21/0728 482/106 |
| 2003/0096683 | A1 | 5/2003 | Fenelon et al. | |
| 2003/0114276 | A1 | 6/2003 | Schiff | |
| 2003/0148862 | A1 | 8/2003 | Chen et al. | |
| 2004/0005968 | A1 * | 1/2004 | Crawford | A63B 21/0607 482/106 |
| 2006/0025287 | A1 | 2/2006 | Chermack | |
| 2007/0037675 | A1 | 2/2007 | Doudiet | |
| 2008/0064575 | A1 | 3/2008 | Towley, III et al. | |
| 2009/0163335 | A1 | 6/2009 | Towley, III et al. | |
| 2009/0197745 | A1 | 8/2009 | Olson | |
| 2009/0305852 | A1 | 12/2009 | Höglund | |
| 2010/0229616 | A1 | 9/2010 | Fink et al. | |
| 2010/0304938 | A1 | 12/2010 | Olson | |
| 2012/0021877 | A1 | 1/2012 | Lundquist et al. | |

* cited by examiner

FREESTANDING SELECTABLE FREE WEIGHT ASSEMBLY

FIELD OF THE INVENTION

The present invention generally relates to a selectable free weight assembly having an improved locking mechanism.

BACKGROUND

An adjustable weight dumbbell apparatus enables a user to have access to a plurality of differing weight sets in a single handset by facilitating the addition or subtraction of weight (i.e., weight plates) from the apparatus. In the past, the use of free weight dumbbells generally offered the user one of two options. The first option was a plurality of free weight dumbbells of solid mass in a sufficient number to fulfill the entire desired free weight requirement (i.e., multiple pairs of dumbbells). The second option was an adjustable dumbbell that required physically clamping or securing the weights to a handset using a hand wrench manual locking apparatus. More recently, adjustable dumbbells have incorporated different mechanisms for securing the weight plates to each other and to the handset.

During use, free weight assemblies are often dropped from elevated positions. And even though conventional adjustable weight assemblies employ various locking mechanism, the weight plates can still become disengaged when the assemblies are dropped. This can cause the weight plates to become detached from the handset and can result in permanent damage to the assemblies. Therefore, there exists a need for an adjustable weight assembly with a more secure locking mechanism.

SUMMARY

In one aspect, a weight plate for use in an adjustable weight set generally comprises a weight plate member having a plate surface. A centrally disposed hole in the weight plate member is configured to receive a handle assembly of the adjustable weight set for retaining the weight plate to the weight set. A locking mechanism on the weight plate member secures the weight plate to another weight plate of the set. The locking mechanism comprises a plurality of spaced apart locking elements each being formed by at least one cut in the weight plate member. At least a portion of each locking element is displaced from the plate surface forming a slot behind the locking element. The slot is configured to receive a locking element on said another weight plate of the set to secure the weight plate to said another weight plate. The locking elements are arranged relative to each other and to the centrally disposed hole for securely retaining the weight plate and said another weight plate to each other.

In another aspect, an adjustable weight set apparatus generally comprises a handle having a first end portion and a second end portion opposite the first end portion and an adjustment assembly. A first weight set is adapted to be supported on the first end portion of the handle and a second weight set is adapted to be supported on the second end portion of the handle. Each of the first and second weight sets comprises a plurality of weight plates. Each weight plate comprises a weight plate member having a plate surface and a centrally disposed hole in the weight plate member configured to receive the handle for retaining the weight plate to the weight set. A locking mechanism on the weight plate member secures the weight plate to another weight plate of the set. The locking mechanism comprises a plurality of spaced apart locking elements each being formed by at least one cut in the weight plate member. At least a portion of each locking element is displaced from the plate surface forming a slot behind the locking element. The slot is configured to receive a locking element on said another weight plate of the set to secure the weight plate to said another weight plate. The locking elements are arranged relative to each other and to the centrally disposed hole for securely retaining the weight plate and said another weight plate to each other.

Other aspects of the present invention will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
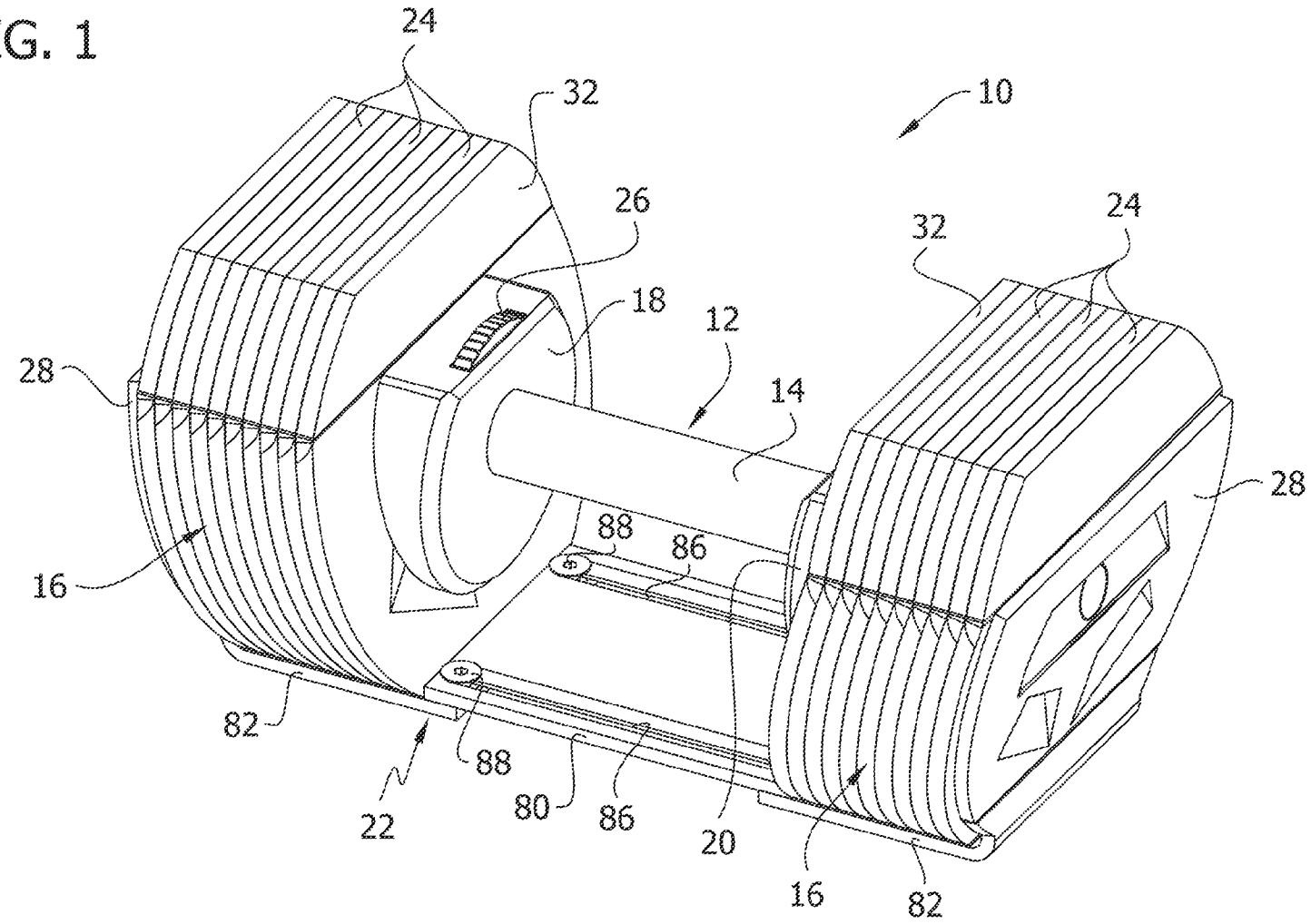
FIG. 1 is a perspective of a free weight dumbbell apparatus of the present invention.

Referring now to the drawings, and more specifically to FIGS. 1-4, a freestanding selectable free weight dumbbell apparatus 10 generally comprises a dumbbell handle assembly 12 including a tubular handle 14 and a pair of collars 18, 20 mounted on respective ends of the handle. A pair of weight plate sets 16 are supported by the handle assembly 12 and an adjustable retainer 22 is adapted for holding the handle assembly 12 and weight plate sets 16. Each weight plate set 16 comprises a plurality of weight plates 24 arranged in mating sequence between respective collars 18, 20 and retainer end plates 28. A dial 26 (broadly, a "selector element") mounted on collar 18 adjusts the number of weight plates 24 in each set 16 supported by the handle assembly for varying the total weight of the apparatus 10. A portion of the handle 14 extends between the collars 18, 20 for allowing a user to grasp and manipulate the apparatus 10.

Figure 5:
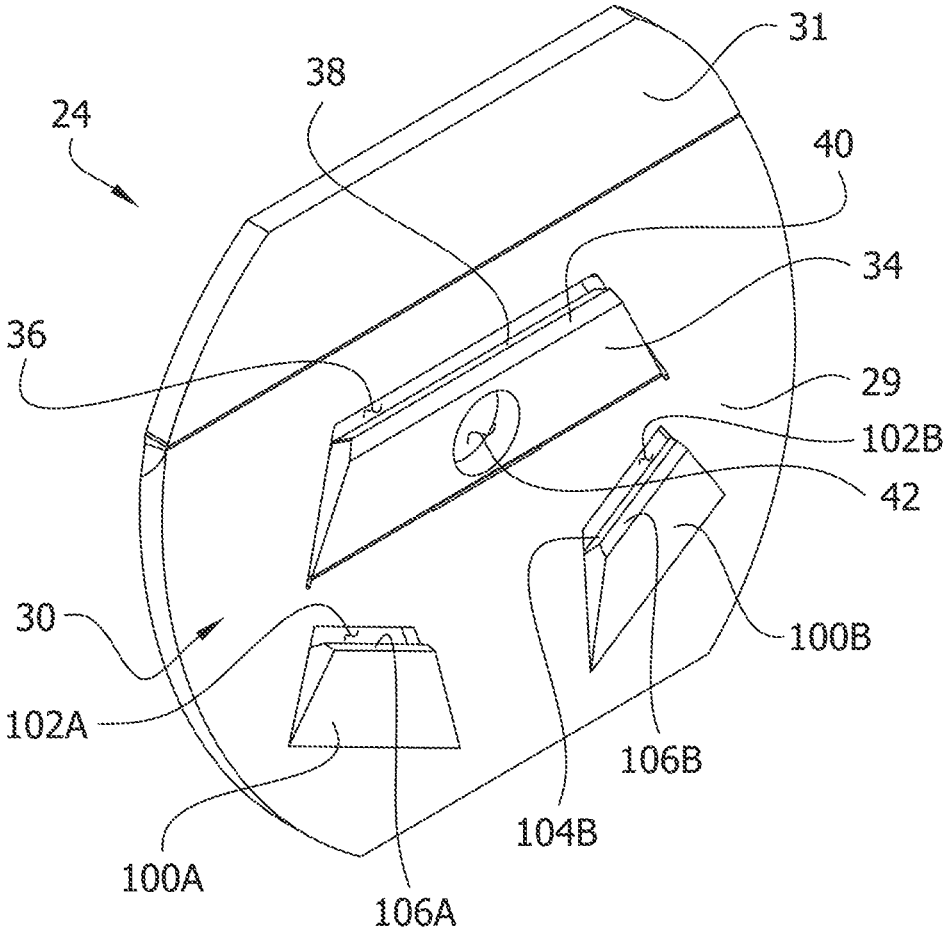
FIG. 5 is a perspective of a weight plate of the apparatus.
Figure 5A:
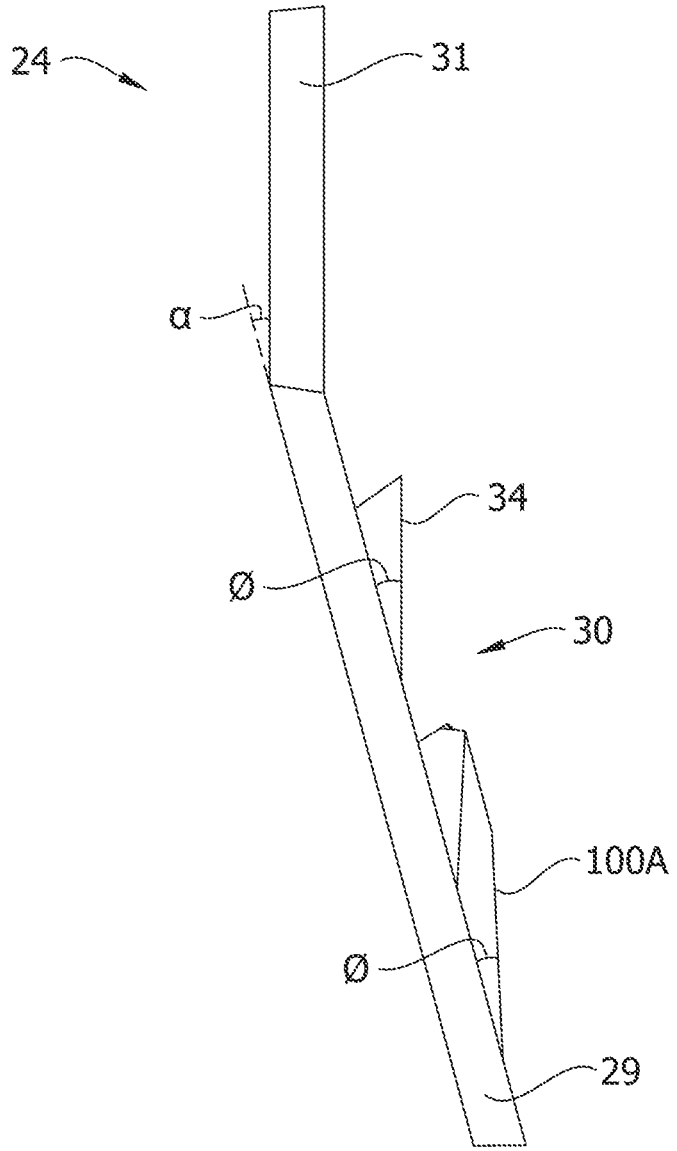
FIG. 5A is a side view of the weight plate.

Referring to FIG. 5, each weight plate 24 comprises a main body portion 29 and a top bent portion 31 extending from the body portion at a skewed angle. In a preferred embodiment, the top bent portion 31 is skewed from the main body portion 29 by an angle α of about 12 degrees (FIG. 5A). This configuration of the weight plates 24 reduces the overall length of the apparatus 10 as compared to weight plates without a bend. As a result, the shape of the weight plates 24 creates a more compact apparatus 10 which makes for a more easy manipulation of the apparatus. The weight plates 24 may have other shapes without departing from the scope of the present invention. For instance, the weight plates could be substantially round or substantially rectangular.

Figure 2:
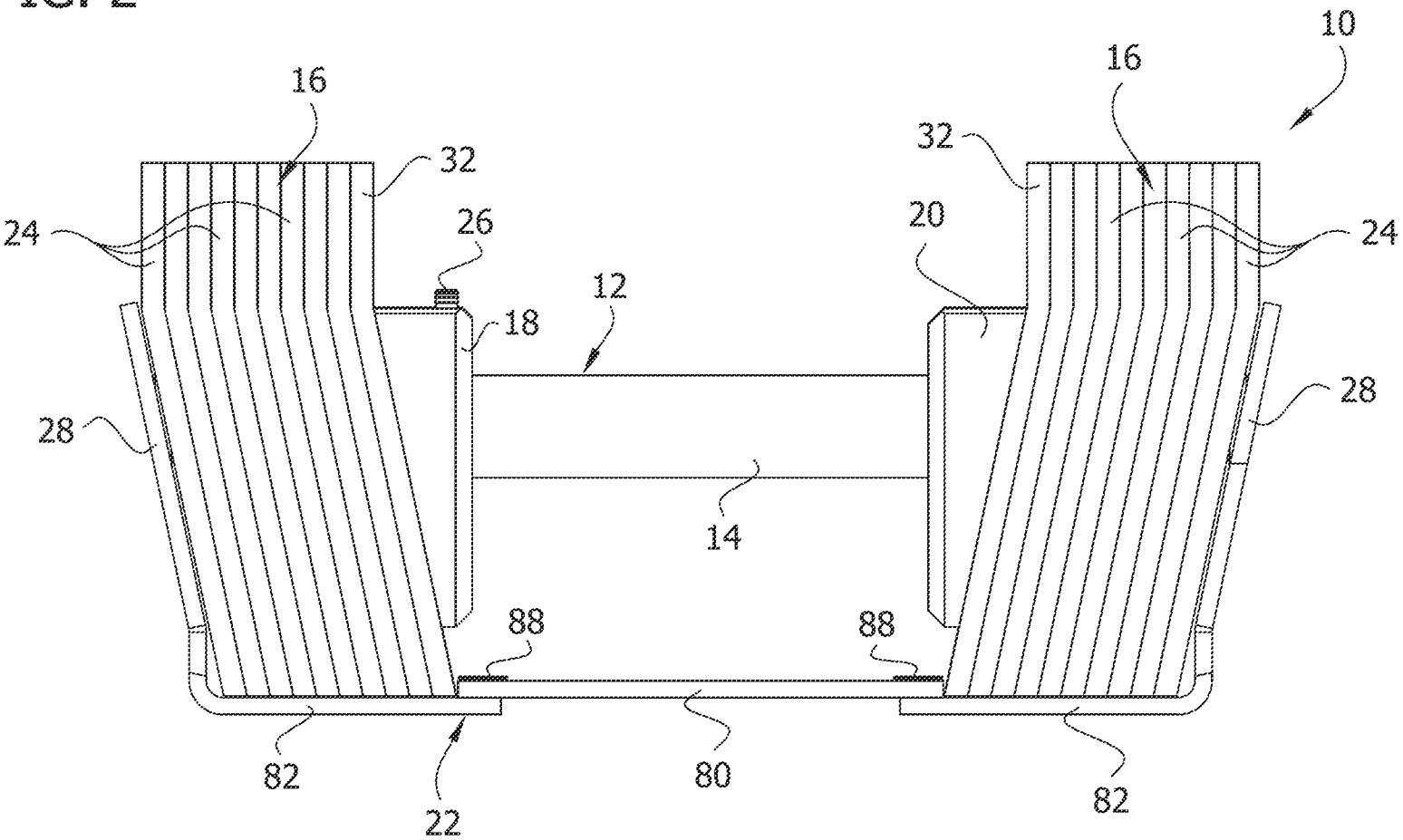
FIG. 2 is a side view of the apparatus.
Figure 3:
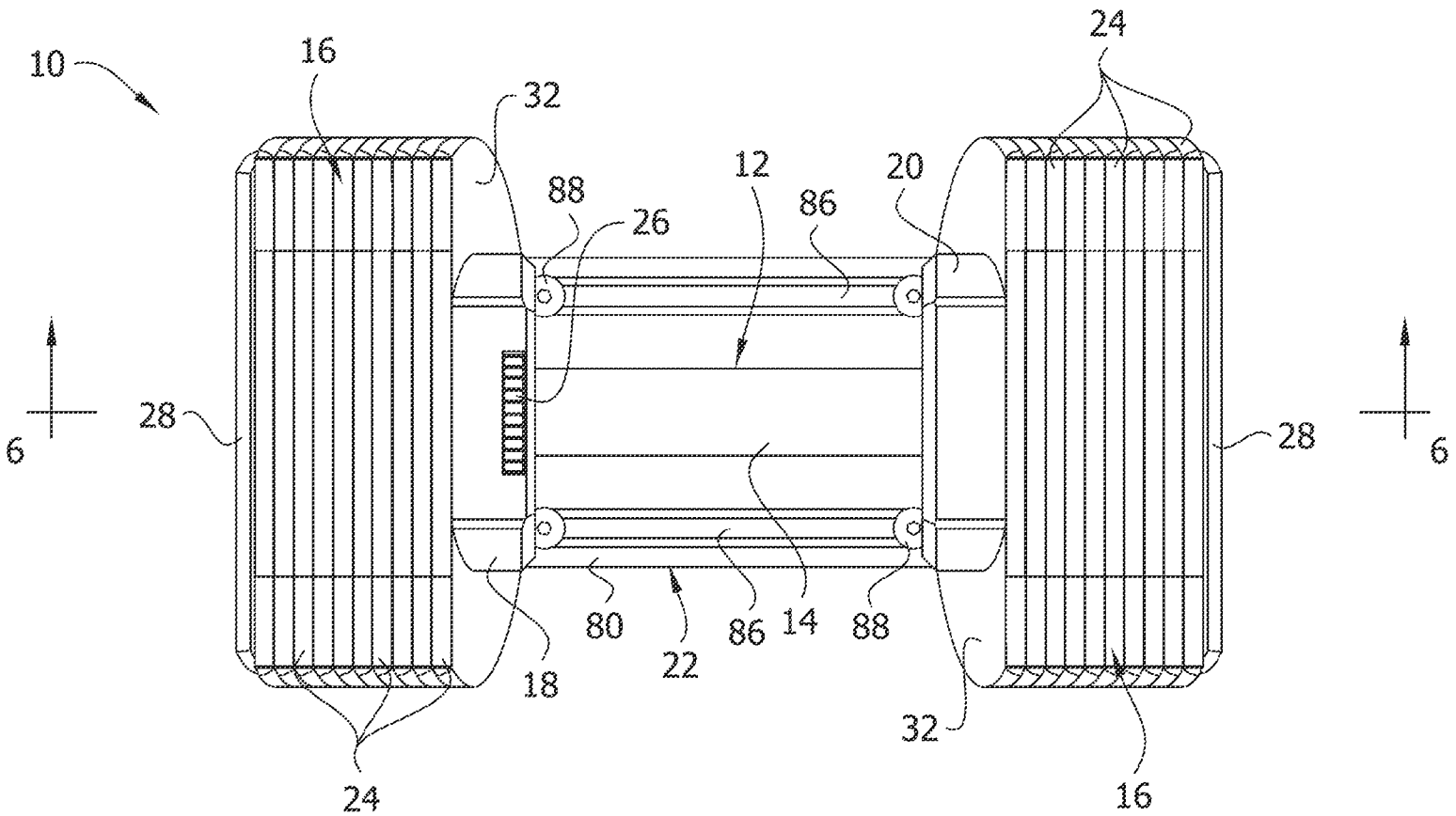
FIG. 3 is a top view of the apparatus.

Each collar 18, 20 has a collar plate 32 fixed to the respective collar for engaging the first weight plate 24 of the weight set 16 (FIGS. 1 and 2). The collar plates 32 can be made of a suitable material such as steel and have, as illustrated, the same overall shape as the weight plates. However, it is to be understood that the collar plates may have a shape different from the shape of the weight plates. For example a collar plate (not shown) may be slightly smaller than the weight plates 24 shown in the drawings so as to accommodate weight plates of different shapes (e.g., circular weight plates, not shown) without projecting out from any peripheral edge of either shape of weight plate. The weight plates 24 can be made of a suitable material such as steel and the weight plates in each set 16 are designed to lock together in sequence from the collar 18, 20 toward the retainer 22. The weight plates 24 are also designed to lock to the collar plates 32 and retainer end plates 28.

Figure 4:
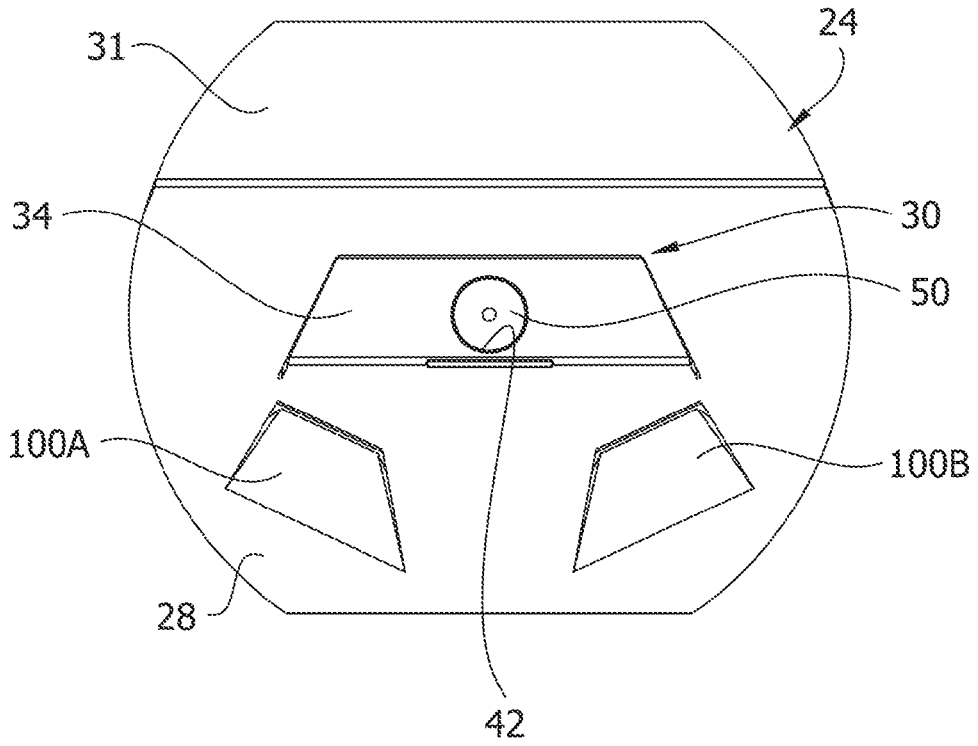
FIG. 4 is an end view of the apparatus.
Figure 5B:
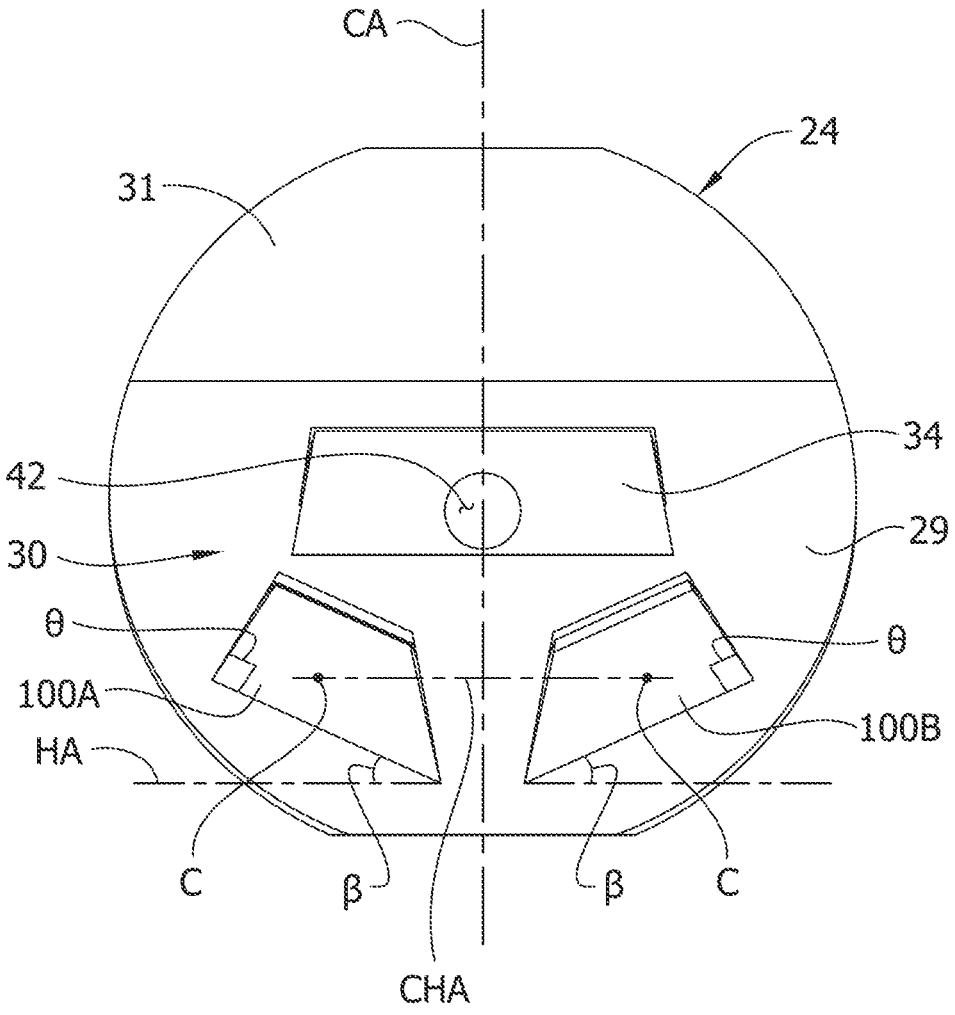
FIG. 5B is a front view of the weight plate.

Referring to FIGS. 4-5B, the weight plates 24, collar plates 32 and retainer end plates 28 each have locking mechanisms 30 for attaching to adjacent plates. Specifically, the locking mechanisms 30 function to lock two adjoining weight plates 24 together, or a weight plate to either one of the collar plates 32 or to one of the retainer end plates 28. The locking mechanisms 30 include a central locking tang 34 (broadly, a first locking element) formed by making a three-sided cut (two lateral side cuts and a transverse top cut) in each of the plates 24, 28, 32. The area inside the cut is bent outward along a tang bend at an angle, forming the locking tang 34. The void left by the tang 34 forms a central locking slot 36. Additionally, the two lateral side cuts taper toward the top cut such that a bottom edge of the tang 34 is longer than a top edge of the tang. In the illustrated embodiment, the tang 34 has an isosceles trapezoidal shape. However, the tang 34 could have other shapes such as non-isosceles trapezoidal, rectangular or semi-circular without departing from the scope of the present invention. As such, any number of straight or curved cuts could be used to form the tang.

The central locking tangs 34 are designed to facilitate locking and unlocking of the weight plates 24, collar plates 32 and retainer end plates 28 during use of the apparatus 10. The top edge of each tang 34 has an angled flush face 38 and a locking surface 40. The flush face 38 is angled so that it will not interfere with the surface of an adjoining plate. The locking surface 40 is designed to engage and lock into an upper portion of a central locking slot 36 of an adjacent weight plate 24 or collar plate 32. This method of construction allows for the necessary positioning of the central locking tangs 34 with respect to adjoining central locking slots 36 while providing a mechanism that allows for the placement of a plurality of weight plates 24 flush up against one another.

The locking mechanism 30 further comprises secondary tangs 100A, 100B (broadly, second locking elements) on the plates 24, 28, 32. Like the central tang 34, each secondary tang 100A, 100B is formed by making a three-sided cut (two lateral side cuts and a transverse top cut) in each of the plates 24, 28, 32. The area inside each cut is bent outward along a secondary tang bend at an angle, forming the secondary tangs 100A, 100B. The voids left by the secondary tangs 100A, 100B form secondary locking slots 102A, 102B. Additionally, the two lateral side cuts taper toward the top cut such that a bottom edge of each of tangs 100A, 100B is longer than a top edge of the tangs. In the illustrated embodiment, the secondary tangs 100A, 100B have a trapezoidal shape. However, the tangs 100A, 100B could have other shapes such as isosceles trapezoidal, rectangular or semi-circular without departing from the scope of the present invention. As such, any number of straight or curved cuts could be used to form the tangs 100A, 100B.

The secondary tangs 100A, 100B are designed to facilitate locking and unlocking of the weight plates 24, collar plates 32, and retainer end plates 28 during use of the apparatus 10. The top edge of each tang 100A, 100B has an angled flush face 104A, 104B and a locking surface 106A, 106B. Flush faces 104A, 104B are angled so that they will not interfere with the surface of an adjoining plate. The locking surfaces 106A, 106B are designed to engage and lock into upper portions of corresponding secondary locking slots 102A, 102B. As with the central locking tang 34, this method of construction allows for the necessary positioning of the secondary tangs 100A, 100B with respect to adjoining secondary locking slots 102A, 102B.

In the illustrated embodiment, the secondary tangs 100A, 100B are smaller than the central tang 34 and disposed generally below the central tang such that a center of each secondary tang is positioned about half way between the bottom edge of the tang 34 and a bottom edge of the weight plate 24. The secondary tangs 100A, 100B are mirrored about a central vertical axis CA of the weight plate 24 and angled upward from a horizontal axis HA an angle β of about 25 degrees. The angle β may between 0 and about 30 degrees. The outer lateral cut and bend of each secondary tang 100A, 100B form an angle θ of about 90 degrees. The angle θ may be between about 90 and about 45 degrees. This configuration of the secondary tangs 100A, 100B resists relative lateral movement between the weight plate 24 and an adjacent weight plate 24 in the set 16 as will be explained in greater detail below.

By providing multiple tangs 34, 100A, 100B on each plate 24, 28, 32 the dumbbell apparatus 10 is better equipped to stay intact when in use, and in particular when the apparatus is dropped from an elevated position. The center tang 34 provides a central locking feature which directly secures adjacent plates 24, 28, 32 together at their centers. The secondary tangs 100A, 100B provide an additional peripheral locking feature which directly secures adjacent plates together nearer the edges, and in particular the bottom edge, of the plates. Therefore, forces on the plates 24, 28, 32 tending to disengage the plates from each other are counteracted by locking elements located both centrally and peripherally on the plates. Further, because the secondary tangs 100A, 100B are angled upward from horizontal, the secondary tangs provide increased resistance to lateral forces on the plates that can occur when the apparatus 10 is dropped. The substantially orthogonal angle between the outer lateral cut and bottom bend of the secondary tangs 100A, 100B (angle θ) further configures the secondary tangs to counteract lateral forces on the plates 24, 28, 32. Thus, the multi-tang configuration is a significant improvement over single-tang weight plates. By comparison, a single tang configuration such as one single central tang does not provide direct resistance to peripheral forces on the weight plates. The single central tang configuration also does not provide significant resistance to relative lateral movement of the plates 24, 28, 32. As a result, the weight plates are more susceptible to being disengaged from each other and jarred loose from the handle assembly 12 when subject to certain directional impacts that may occur when the weight set is dropped. Therefore, the use of multiple tangs in the current disclosure provides a superior and more robust locking mechanism better equipped to withstand the impacts of use.

In the illustrated embodiment, central locking tang 34 is positioned generally centrally on the weight plate 24 and two secondary locking tangs 100A, 100B are disposed generally below the central tang 34. However, the plates 24, 28, 32 could include only a single secondary tang (FIG. 5F) or could include more than two secondary tangs. Also, the secondary tang(s) could be positioned on sides or above the central locking tang 34, or the central tang could be omitted (FIG. 5E).

In the illustrated embodiment, weight plates 24 include two secondary tangs 100A, 100B that are substantially identical in size. However, secondary tangs of differing sizes could be used without straying from the scope of this invention. Further, in the illustrated embodiment, a center C of each secondary tang 100A, 100B is disposed on a common horizontal axis CHA, and the tangs are each spaced equidistant from the central vertical axis CA of weight plate 24. In alternative embodiments (not shown), the secondary tangs 100A, 100B could be positioned at different vertical positions on the weight plate 24 and/or could be asymmetrically spaced relative to the center vertical axis CA of the weight plate 24. Thus, the invention is not limited to embodiments where secondary tangs 100A, 100B are mirror images of one another.

As discussed above, the weight plates 24 each comprise a main body portion 29 and a top bent portion 31. The top bent portion is formed by bending weight plate 24 to angle α, (broadly, a body angle). Similarly, as discussed above, each of tangs 34, 100A, 100B are bent outward to an angle ø (FIG. 5A), (broadly, a tang angle). The body angle α can be the same as the tang angle Ø at a preferred angle of about 12 degrees. However, the body angle α and the tang angle ø can be different from each other. Also, angles α and ø could be less than or greater than 12 degrees. For instance, the body angle α can range from 0 degrees to about 50 degrees and the tang angle Ø can range from about 10 degrees to about 50 degrees.

In the illustrated embodiment, the bent portions 31 and each of the tangs 34, 100A, 100B are oriented in a substantially upright position and the main body portions 29 are skewed inwards when the apparatus 10 is resting on a horizontal surface. Each tang locking surface 40, 106A, 106B engages an adjacent upper portion of slot 36, 102A, 102B, respectively. Upper portions of slots 36, 102A, 102B act inward and downward on locking surfaces 40, 106A, 106B, respectively. Since engagement surfaces 40, 106A, and 106B are each oriented in different directions, a plate 24, 28, 32 more securely locks to an adjacent plate as compared with a single tang plate. It is also envisioned that the collar plates 32 and retainer plates 28 could have a locking mechanism different from the locking mechanism of the weight plates 24.

Figure 5C:
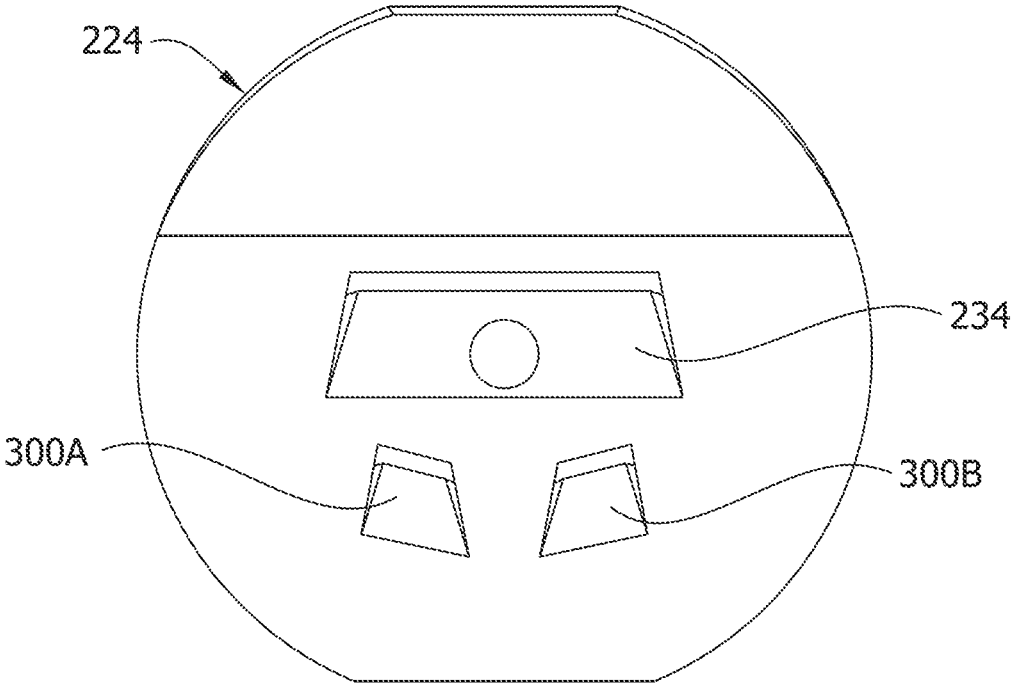
FIG. 5C is a front view of a weight plate of a second embodiment.
Figure 5D:
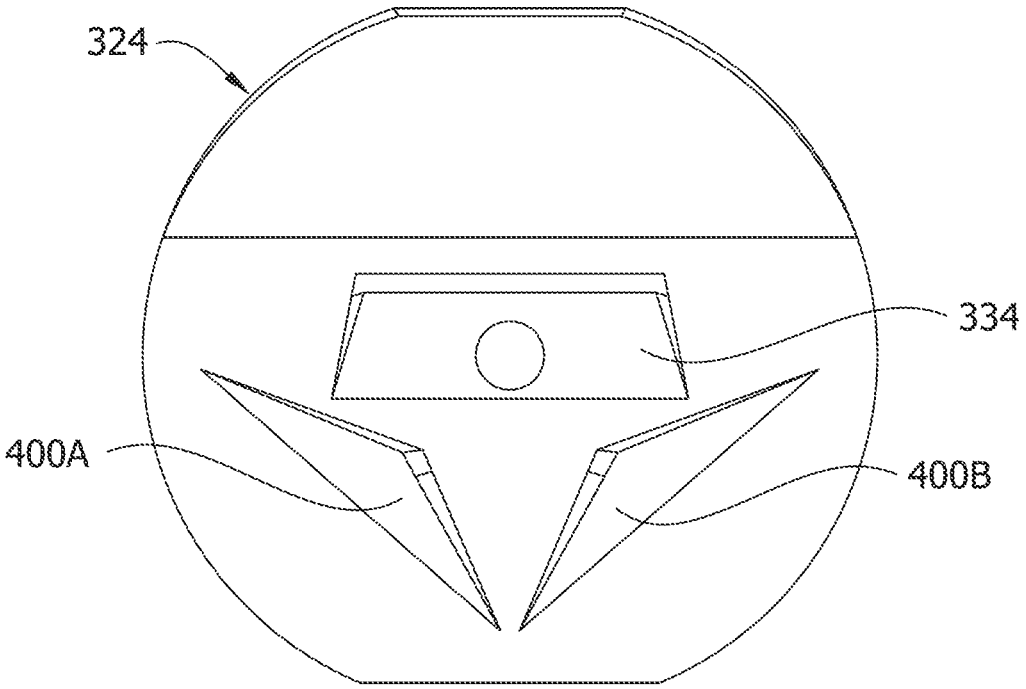
FIG. 5D is a front view of a weight plate of a third embodiment.
Figure 5E:
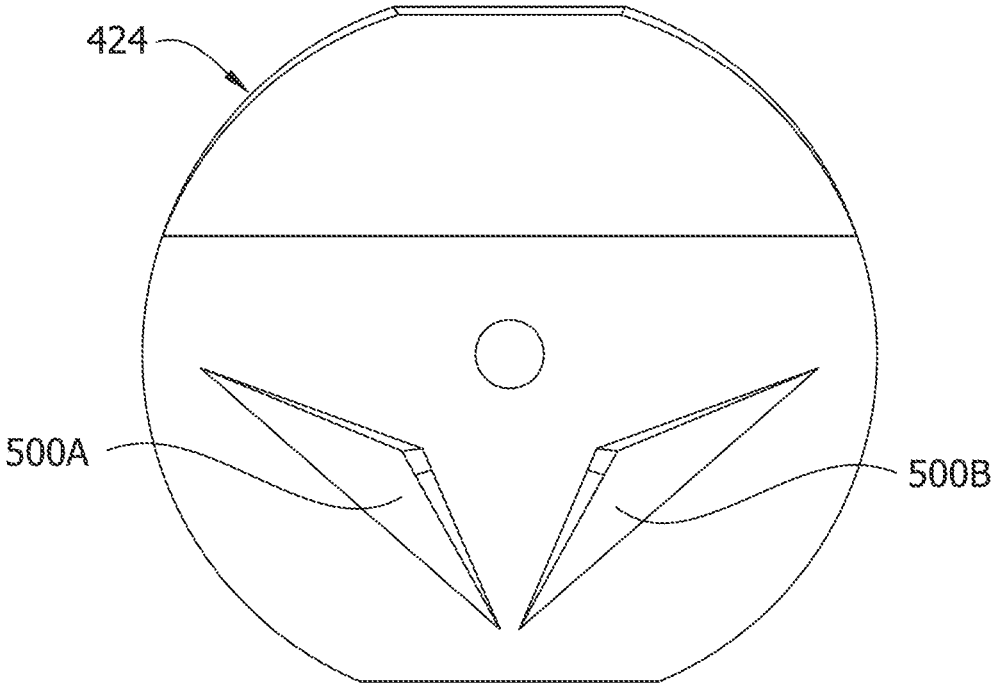
FIG. 5E is a front view of a weight plate of a fourth embodiment.
Figure 5F:
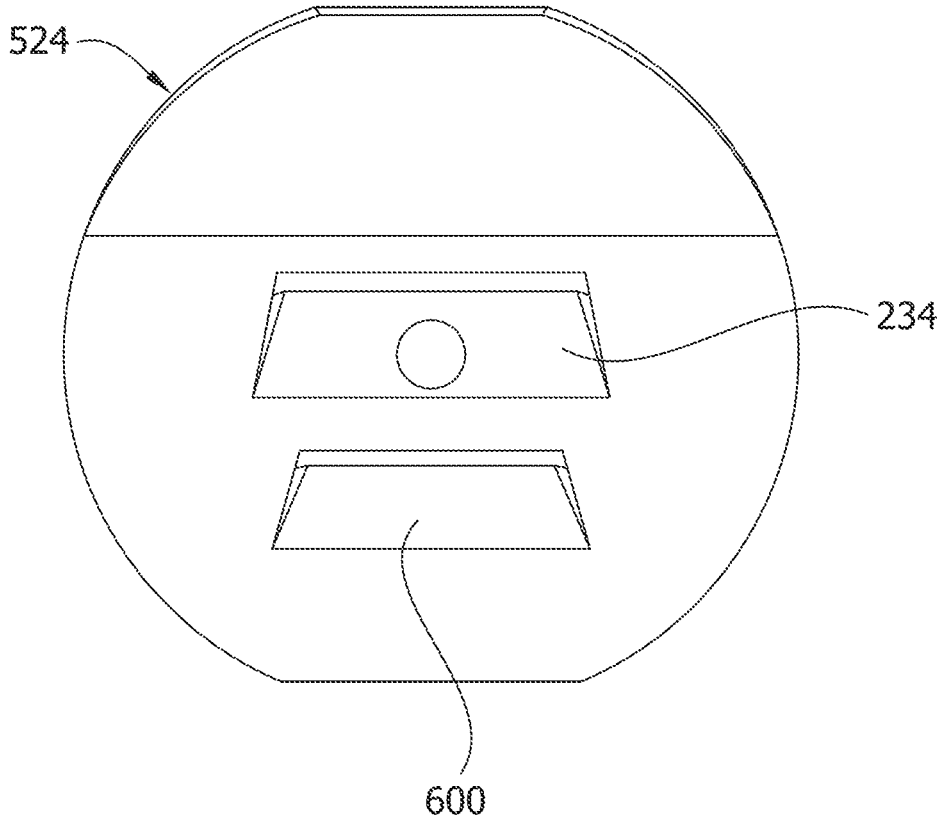
FIG. 5F is a front view of a weight plate of a fifth embodiment.

FIG. 5C shows a second embodiment of a weight plate 224 having a central tang 234 and secondary tangs 300A, 300B that are more than half the size of the central tang. FIG. 5D shows a third embodiment of a weight plate 324 having a central tang 334 and two triangular secondary tangs 400A, 400B. FIG. 5E shows a fourth embodiment of a weight plate 424 having two triangular secondary tangs 500A, 500B and omitting the central tang. FIG. 5F shows a fourth embodiment of a weight plate 524 having a central tang 534 and a single secondary tang 600. It is understood that if weight plates as shown in either FIGS. 5C-5F are utilized in the apparatus 10, the collar plates 32 and retainer end plates 28 may have identical locking mechanisms.

Figure 6:
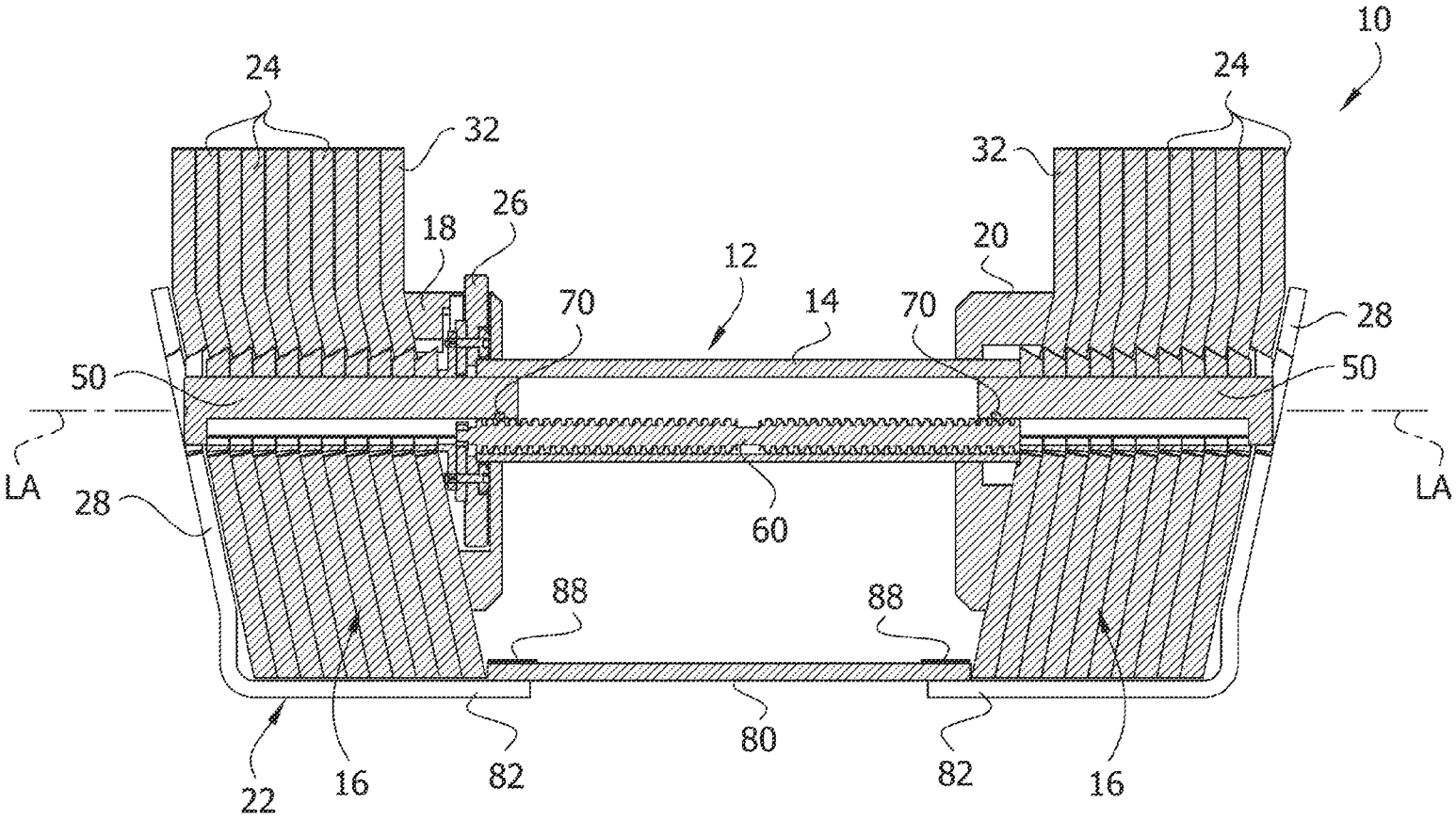
FIG. 6 is a cross section of the apparatus taken through line 6-6 in FIG. 3.
Figure 7:
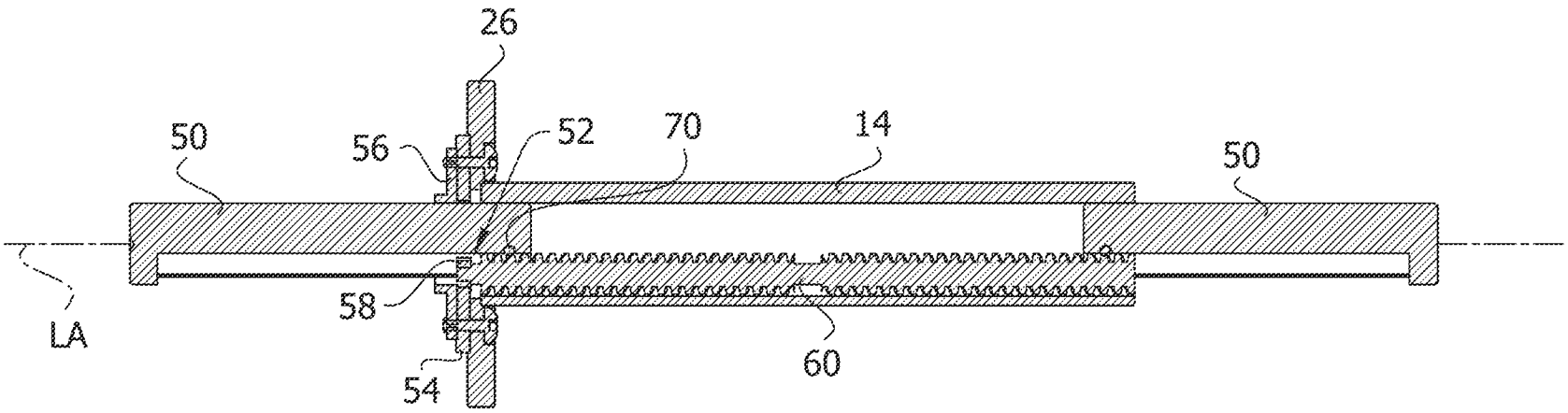
FIG. 7 is a cross section of a handle assembly and adjustment assembly of the apparatus.
Figure 8:
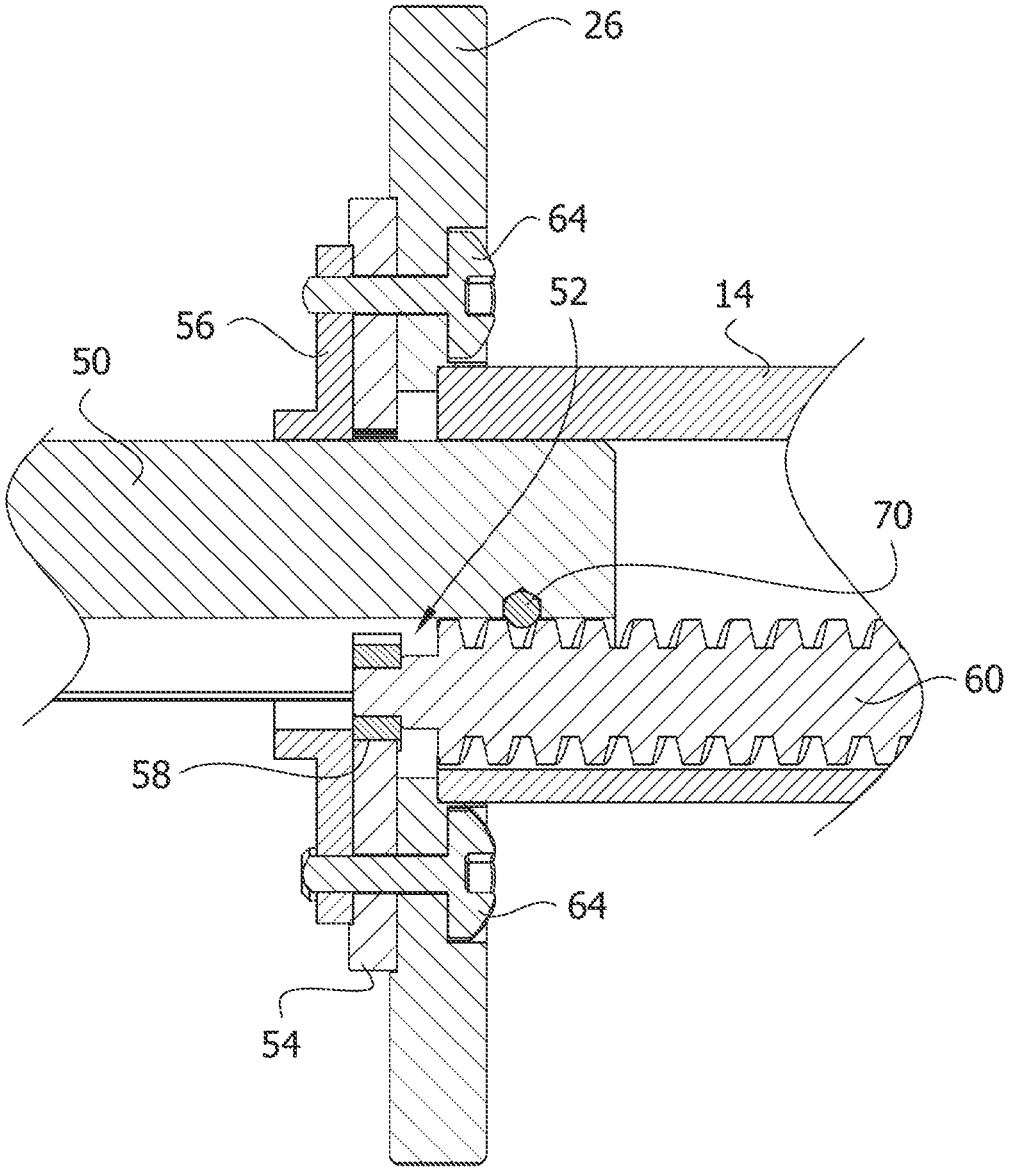
FIG. 8 is an enlarged fragmentary view of FIG. 7.
Figure 9:
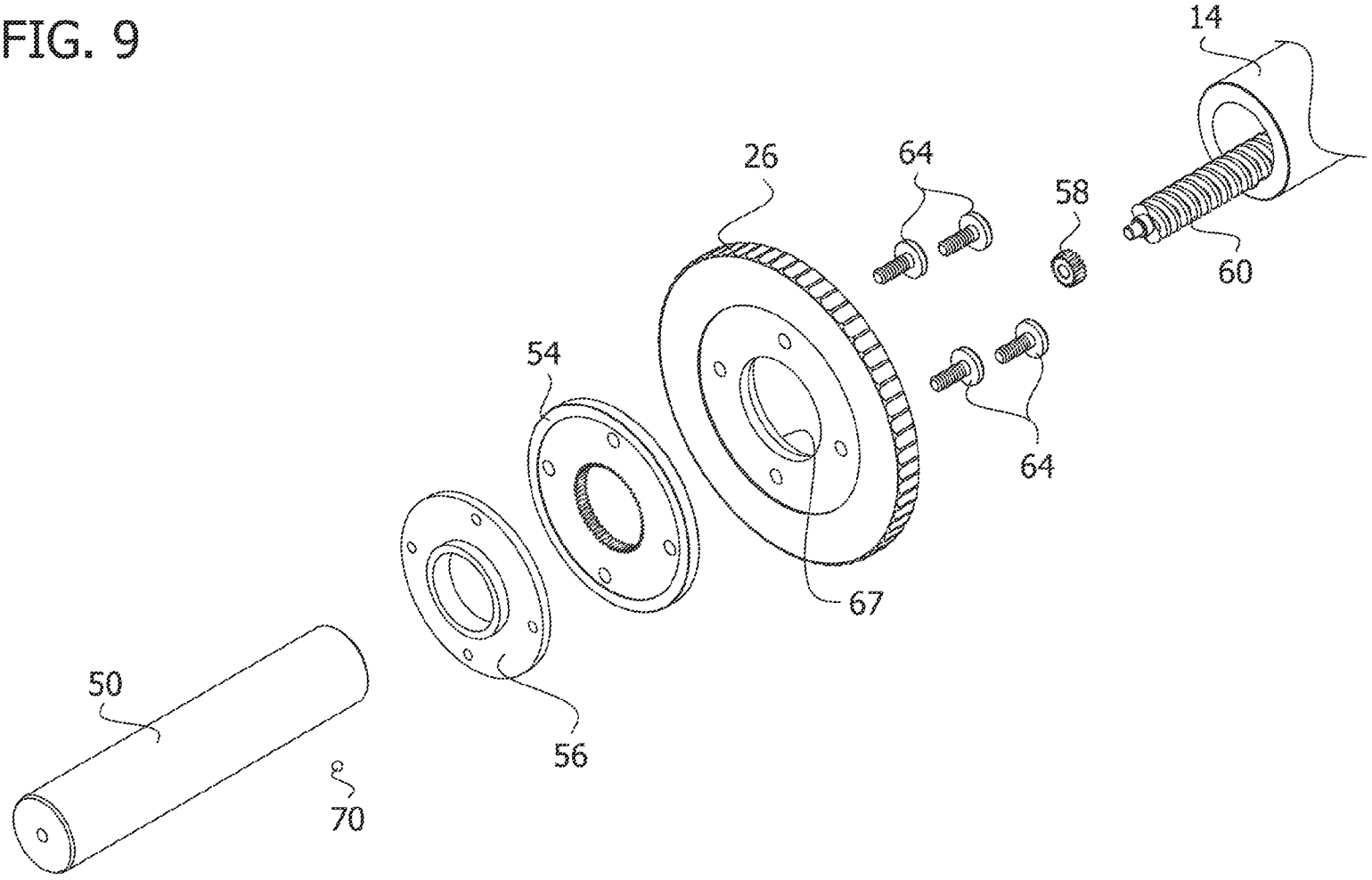
FIG. 9 is an exploded view of a portion of the handle assembly and adjustment assembly.

It is also envisioned that the locking elements can be an embossment (not shown) formed by punching a portion of the weight plate outward from the main body portion of the plate. This process forms transition side surfaces that are bent from the main body portion and connect the main body portion to the locking mechanism giving the locking mechanism a generally "raised" configuration. A top surface of each embossment may be beveled to facilitate the locking of adjoining weight plates. The void left by the embossment forms a locking slot, such that the embossment on an adjoining plate rests in the locking slot to lock the plates together. The beveled top surface of each embossment is angled so that it will not interfere with the surface of an adjoining plate. The beveled top surface is designed to engage and lock into an upper portion of a locking slot of an adjacent plate. Therefore, the embossment would function substantially the same as the disclosed tangs. One example of an embossment locking element is shown in my International Patent Application No. PCT/US2011/58420, the disclosure of which is incorporated herein by reference Referring back to the first embodiment, each of the weight plates 24, collar plates 32 and retainer end plates 28 also include selector shaft holes 42 positioned at a center of the plates for allowing the passage of selector shafts 50 (FIG. 6) in and out of the weight plates for selecting the desired amount of weight. The skewed orientation of the collar plates 32 with respect to a longitudinal axis LA of the handle 14, in combination with the locking mechanisms 30, cause a portion of the weight plates 24 to be held at a skewed angle with respect to the longitudinal axis of the handle 14 when the weight plates 24 are retained on the handle assembly 12 (FIG. 2).

Figure 10:
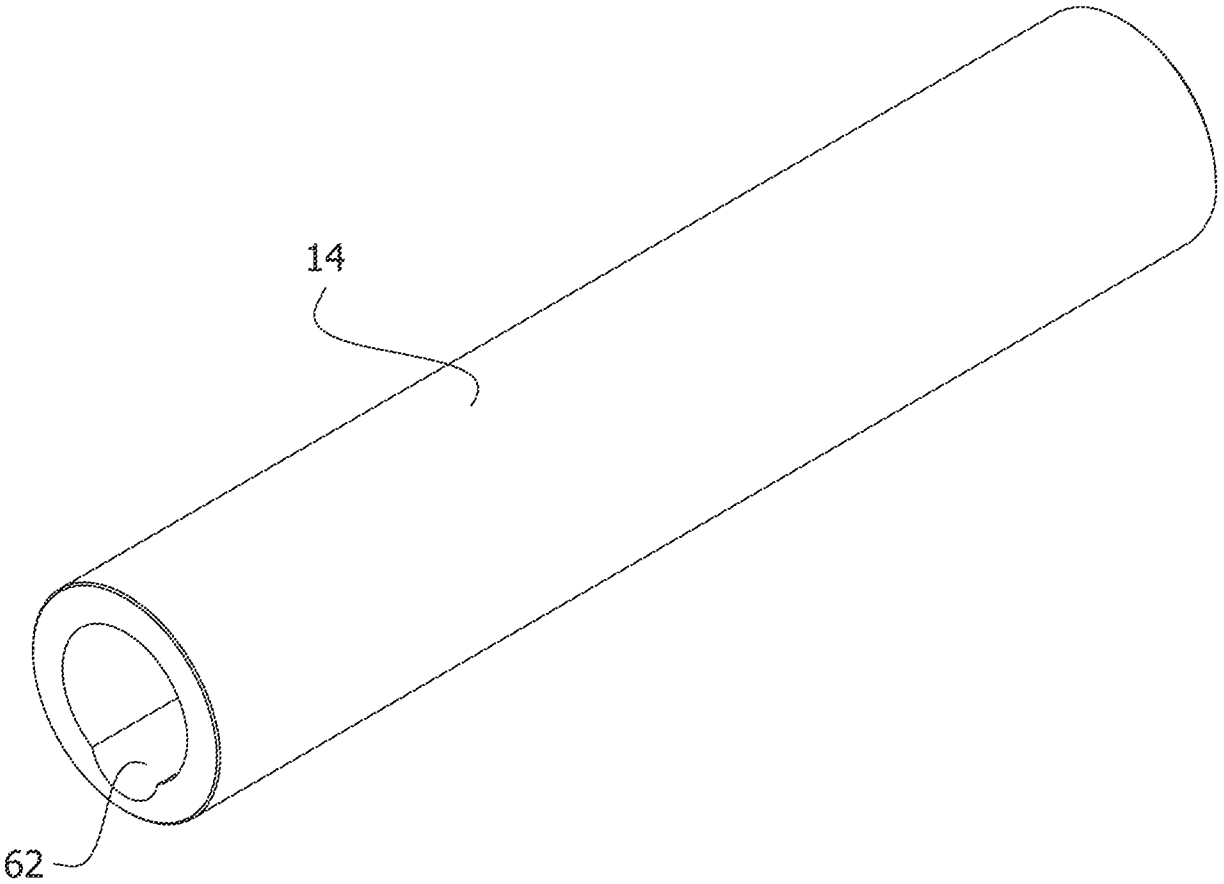
FIG. 10 is a perspective of a handle of the apparatus.
Figure 11:
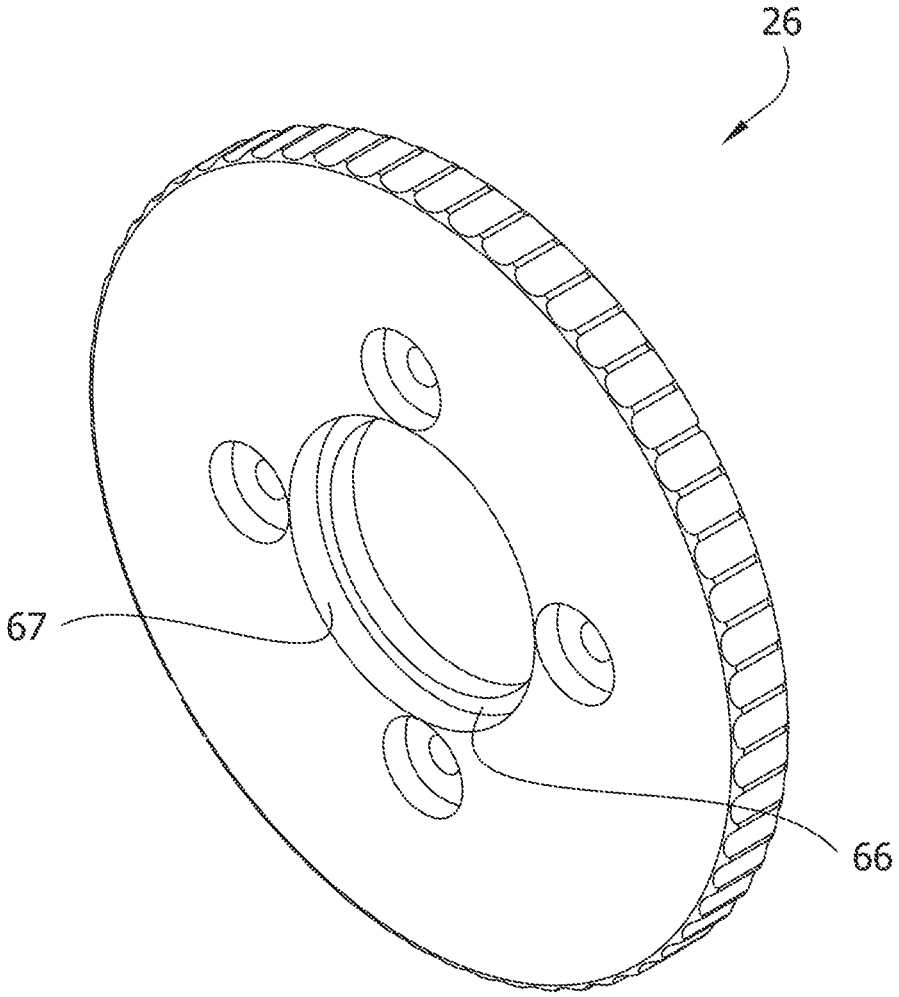
FIG. 11 is a perspective of a dial of the apparatus.

Selection of the desired weight is achieved through manipulation of the dial 26 which in turn actuates components of the handle assembly 12. Referring to FIGS. 6-9, the handle assembly comprises the handle 14, selector shafts 50 and a gear assembly 52. The dial 26 and gear assembly 52 are broadly an adjustment assembly. The gear assembly comprises a ring gear 54, a spacer 56, a mating gear 58 and a threaded shaft 60. The mating gear is mounted on the threaded shaft 60 that is housed in the handle 14 and seated in a channel 62 formed in an inner surface of the handle (FIG. 10). Threads on one half of the shaft 60 are left-handed and threads on the other half are right-handed, the purpose of which will be explained in greater detail below. The dial 26 is mounted on the handle 14 for rotational movement generally about the longitudinal axis LA of the handle 14. The ring gear 54 and spacer 56 are mounted to an outer face of the dial 26 by fasteners 64 so that the ring gear and spacer rotate conjointly with the dial. Other configurations are contemplated, such as the dial 26, ring gear 54 and spacer 56 can be a single piece. The dial 26 has a counterbore 66 on an inner surface that receives an end of the handle 14 so that the dial is located on the handle (FIG. 11). A lip 67 formed by the counterbore 66 retains the dial 26, ring gear 54 and spacer 56 against movement relative to the handle 14 in a perpendicular direction with respect to the longitudinal axis LA of the handle. It is also contemplated that a structure other than a dial can be used. For instance, a knob (not shown) could be used to adjust the number of weight plates 24 in each set 16 supported by the handle assembly 12. Also, in the illustrated embodiment a single dial 26 is used to adjust the weight plates 24 of both weight plate sets 16. However, each weight set 16 could have its own selector element (dial, knob, etc.). It will be understood that the gear assembly 52 will be modified to accommodate the dual selector element configuration. One example of a dual selector element configuration is shown in my U.S. Pat. No. 7,862,487, the disclosure of which is incorporated herein by reference.

Figure 12:
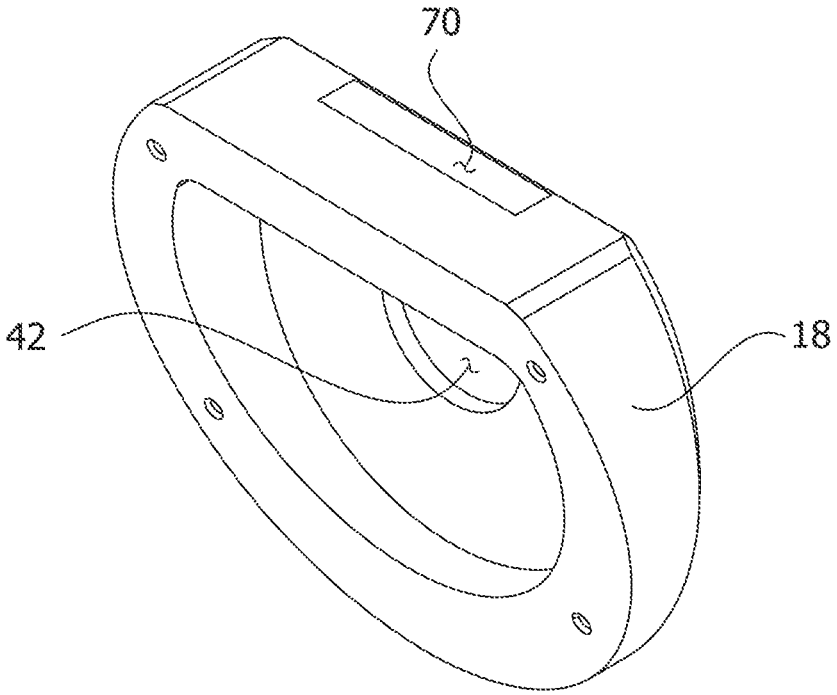
FIG. 12 is a perspective of a collar of the apparatus.

The smaller mating gear 58 engages the ring gear 54 such that teeth on the mating gear mesh with teeth in the ring gear. Thus, rotation of the dial 26 rotates the mating gear 58 which conjointly rotates the threaded shaft 60 at a much higher angular velocity than the dial 26. The channel 62 in the handle 14 constrains the threaded shaft 60 to rotation about an axis substantially parallel to the longitudinal axis LA of the handle. Also, the spacer 56 acts as a stop for restricting longitudinal movement of the threaded shaft 60. Furthermore, the collars 18, 20 can be configured to function as stops for restricting longitudinal movement of the threaded shaft 60. The collar 18 encloses portions of the gear assembly 52. Collar 18 has a slot 70 that passes an upper part of the dial 26 outside of the collar to allow the user to rotate the dial during use (FIG. 12).

The selector shafts 50 are at least partially received in the handle 14 and selector shaft holes 42 by a close tolerance such that movement of the selector shafts and weight plates 24 transverse to the longitudinal axis of the handle is restricted (FIG. 4). This feature provides an advantage over adjustable weight plate sets of the prior art that use internal adjustment components disposed transverse to the drive elements (i.e., selector shafts, threaded shaft). An example of such a device is shown in U.S. Pat. No. 7,862,487. Designs like this require side gaps in their handle assemblies for accommodating the internal components. The gaps cause a loss of conformal engagement between the weight plates and the selector shafts that can lead to relative transverse movement and may also create points of weakness that can cause permanent damage to the apparatus if it is dropped. Also, relative movement in a transverse direction could cause the weight plates 24 to become disengaged with each other. However, by providing structure on the selector shafts 50 that conforms to the round shapes of the selector shaft holes 42 over at least the top halves of the selector shafts, the movement of the weight plates 24 is restricted, helping to eliminate looseness or "slop" and the points of weakness that exist in prior art designs. This is facilitated by the driving engagement of the selector shafts 50 with the gear assembly 52 on the underside of the selector shafts.

Figure 13:
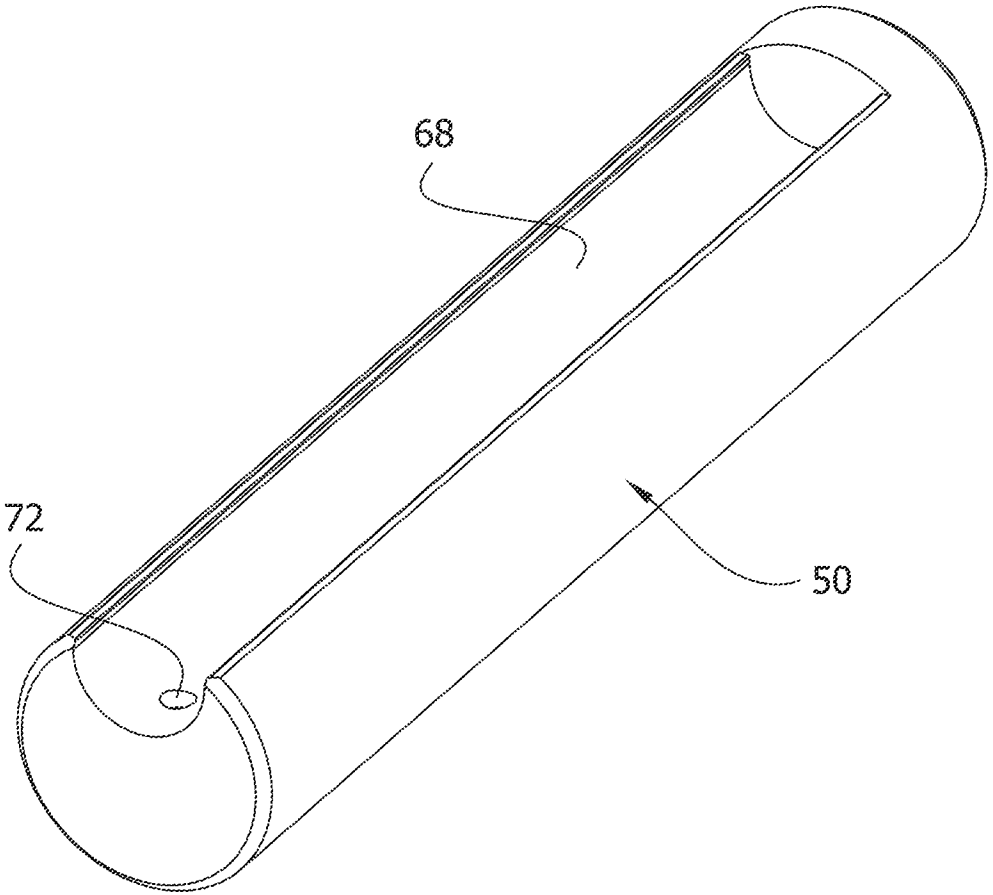
FIG. 13 is a perspective of a selector shaft of the apparatus.

Arcuate channels 68 in the selector shafts 50 are sized and shaped to slidingly receive ends of the threaded shaft 60 to allow the selector shafts to move along the threaded shaft (FIG. 13). Ball bearings 70 mounted in recesses 72 in the arcuate channels 68 are configured to ride along the threads of the threaded shaft 60 to facilitate the movement of the selector shafts 50 along the threaded shaft.

A weight indicator (not shown) can be mounted on collar 18 adjacent the dial 26. A stem (not shown) can extend downward from the indicator through a thickness of the collar 18 such that a distal end portion of the stem extends into an interior space of the collar. A washer (not shown) on the distal end portion of the stem can be configured to engage notches (not shown) spaced around the spacer 56. The notches may be spaced approximately 120 degrees from each other to define about 10 different weight increments of the apparatus 10. Thus, rotation of the dial 26 also causes the indicator to turn showing how much weight is selected. Other ways of indicating the selected weight may be used within the scope of the present invention. The dial 26 may be configured for indexed rotation between locked positions. For example, the axially inward surface of the dial 26 nearest the collar 18 may have receptacles (not shown) formed in it. The receptacles may be angularly spaced apart around the dial face (e.g., at 120° intervals). The opposing, axially outwardly directed surface of the collar 18 may have a spring detent (not shown) mounted thereon that can snap into each of the receptacles as they come into registration with the detent. The detent temporarily holds or "locks" the dial 26 and gear assembly 52. The lock can be overcome by application of sufficient torque to the dial 26.

Figure 14:
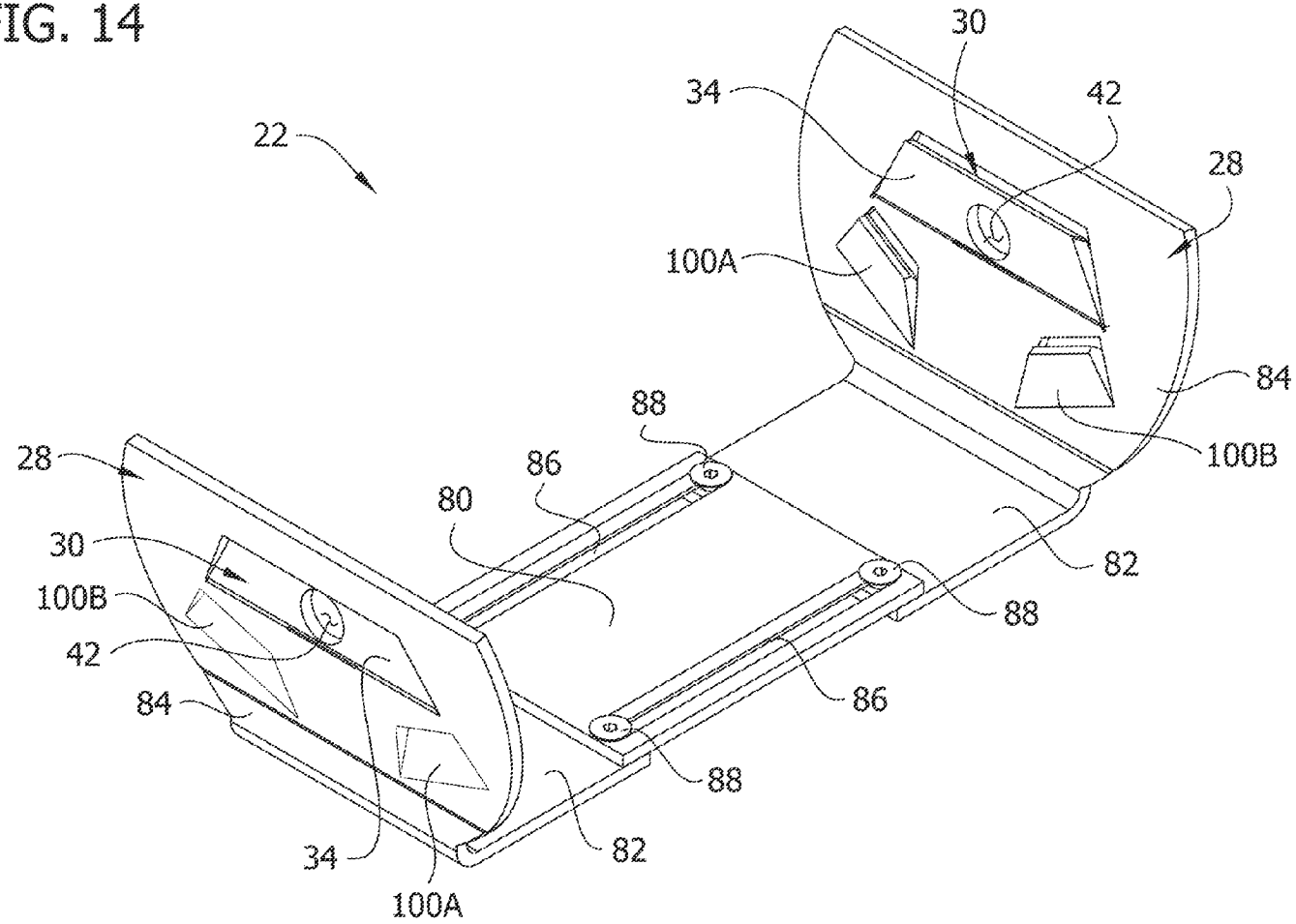
FIG. 14 is a perspective of an adjustable retainer of the apparatus.
Figure 15:
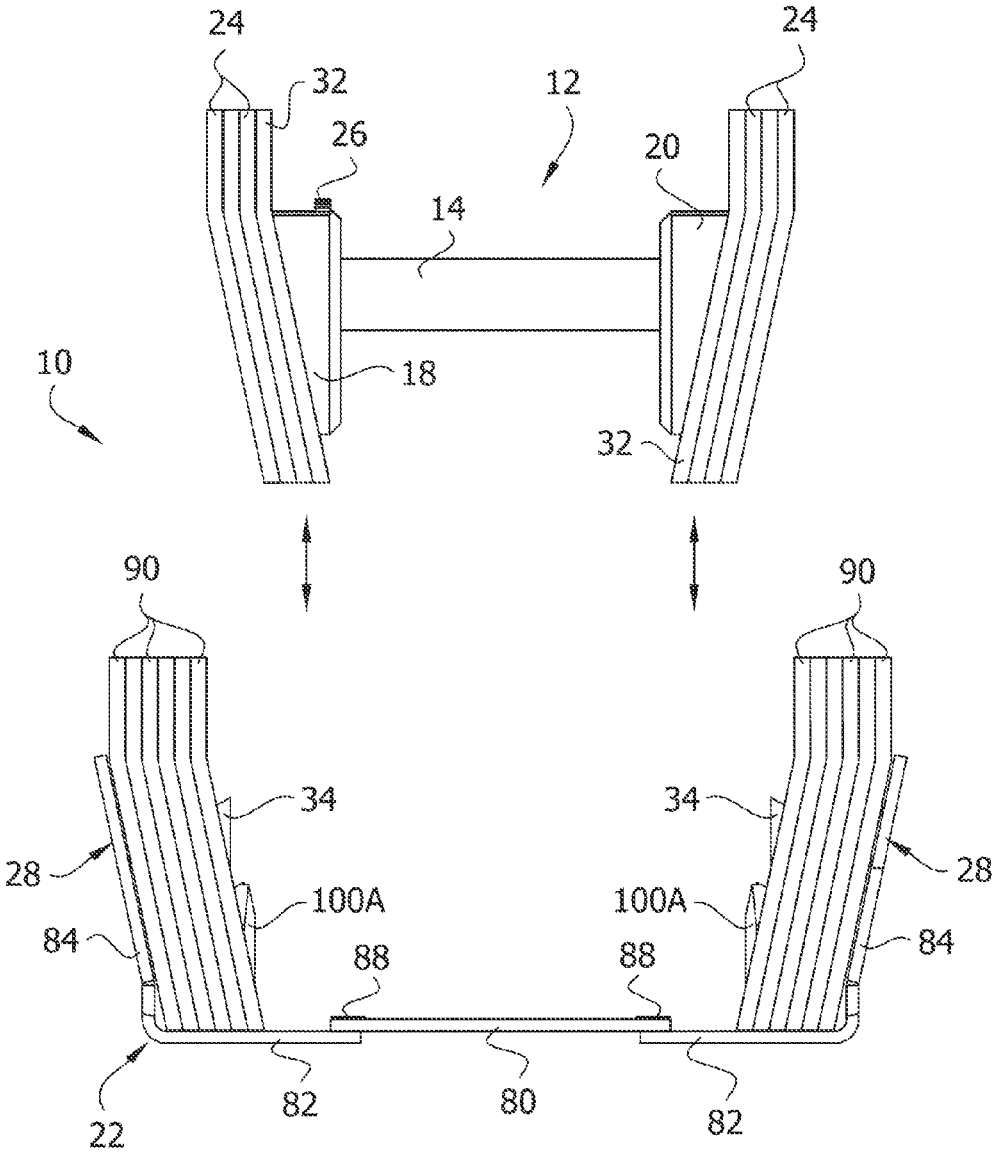
FIG. 15 is an illustration of the operation of the present invention.
Figure 16:
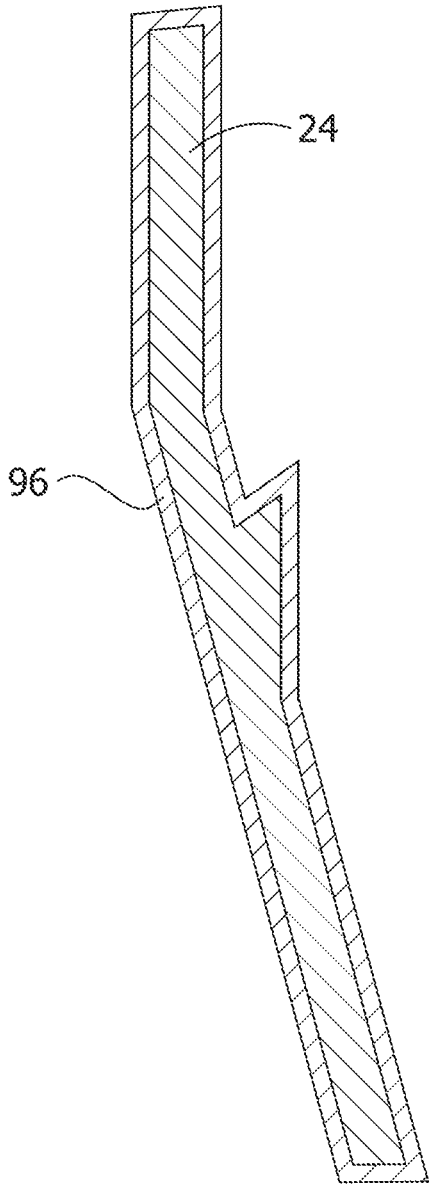
FIG. 16 is cross section of a weight plate having an overmold.

Referring to FIGS. 14 and 15, the retainer 22 includes a center plate 80 and a pair of end plates 28 slidably attached to the center plate. The end plates 28 and center plate 80 may be made out of a suitable material such as steel. Each end plate 28 comprises a base 82 and a plate portion 84 extending upward from the base. The plate portion 84 is substantially identical to the main body portion 29 of the weight plates 24. The center plate 80 has a pair of longitudinal slots 86 adapted to receive fasteners 88 through the slots for fastening to the base 82 of the end plates 28. This configuration allows the end plates 28 to slide inward and outward from the center plate 80 to accommodate the number of weight plates 24 on the handle assembly 12. A one-piece, nonadjustable retainer may also be used without departing from the scope of the invention. It may be seen that all or at least all major components of the apparatus 10 can be made of steel. However, use of other materials does not depart from the scope of the present invention. For instance the weight plates 24 can be formed of a steel core having a plastic or rubber overmold 96 (FIG. 16).

During use, a user selects the desired amount of weight by rotating the dial 26 either clockwise or counterclockwise. In the illustrated embodiment, rotation of the dial in a clockwise direction causes the ball bearings 70 to ride along the respective threads in the threaded shaft 60 moving the selector shafts 50 outward away from each other. As the selector shafts 50 are moved outward they will extend further into the weight sets 16 through the selector shaft holes 42 in the weight plates 24, engaging more weight plates. Therefore, if the user lifts the handle 14 upward the locking mechanisms 30 will cause more weight plates 24 to be retained on the handle assembly 12. Because the retainer end plates 28 are configured with locking mechanisms 30, it is possible to rotate the dial 26 such that the selector shafts 50 extend through the selector shaft holes 42 in the end plates 28 causing the handle assembly 12 to retain the retainer 22 as well. Thus, a user can increase the weight of the apparatus 10 by adding the retainer 22.

Conversely, if the dial 26 is rotated in the counterclockwise direction, the ball bearings 70 will ride along the respective threads moving the selector shafts 50 inward toward each other. This will reduce the number of weight plates 24 engaged by the selector shafts 50, resulting in an apparatus of lesser weight. The apparatus 10 is configured such that the selector shafts 50 will not extend past the outermost weight plate 24 when at least one weight plate or collar plate 32 on each side of the handle 14 is retained by the handle assembly 12.

When it is desired to return the handle assembly 12 and weight plates 24 to the retainer 22, the construction of weight plates and the angled orientation of the retainer end plates 28 facilitate easy docking. The bend between the main body portion 29 and the bent top portion 31 of the weight plates 24 along with the manner in which the weight plates are locked together cause a tapering of the weight plate profile from top to bottom. Residual weight plates 90 left behind in the retainer 22 are supported by the retainer such that their profile also tapers from top to bottom. Thus, inserting the weight plates 24 between the residual plates 90 is made easy because the narrow bottom portion of the weight plates 24 retained by the handle assembly 12 are easily received by the wide top portion of the residual weight plates 90 supported by the retainer 22. In addition, the relatively low profile of the collars 18, 20 and the angled orientation of the collar plates 32 provide greater wrist clearance for the user when handling the apparatus 10. The increased wrist clearance reduces the chance that the wrist of the user will hit the collars 18, 20 thus reducing the chance of injury for the user. In the event that the apparatus 10 is dropped during use, the locking mechanism 30 including the tangs 34, 100A, 100B on the plates 24, 28, 32 securely locks the plates together keeping the plates in place on the apparatus.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An adjustable weight set apparatus comprising:

a handle having a first end portion and a second end portion opposite the first end portion;

an adjustment assembly; and, a first weight set adapted to be supported on the first end portion of the handle and a second weight set adapted to be supported on the second end portion of the handle, each of the first and second weight sets comprising a plurality of weight plates, each weight plate comprising:

a weight plate member having a plate surface;

a centrally disposed hole in the weight plate member configured to receive the handle for retaining the weight plate to the weight set; and a locking mechanism on the weight plate member for securing the weight plate to another weight plate of the set, the locking mechanism comprising a plurality of spaced apart locking elements each being formed by at least one cut in the weight plate member, at least a portion of each locking element being displaced from the plate surface forming a slot behind the locking element, the slot being configured to receive a locking element on said another weight plate of the set to secure the weight plate to said another weight plate, the locking elements being arranged relative to each other and to the centrally disposed hole for securely retaining the weight plate and said another weight plate to each other, the locking elements comprising a first locking element positioned substantially centrally on the weight plate member such that the first locking element includes the centrally disposed hole, and a second locking element disposed below the first locking element;

wherein each weight plate has a width and the first locking element of each weight plate has a width that is greater than one-third of the width of the respective weight plate; and wherein the second locking element of each weight plate has a width that is greater than one-half of the width of the first locking element of the respective weight plate.

2. The adjustable weight set apparatus as set forth in claim 1 wherein each weight plate member includes a lower portion and an upper portion oriented at an angle with respect to the lower portion, each of the first and second locking elements being located on the lower portion of the respective weight plate member.

3. The adjustable weight set apparatus as set forth in claim 2 wherein the upper portion of each weight plate member and each of the first and second locking elements is oriented at about the same angle with respect to the lower portion of the respective weight plate member.

4. The adjustable weight set apparatus as set forth in claim 2 wherein the upper portion of each weight plate member is free of a cut forming a locking element displaced from the upper portion of the weight plate member.

5. The adjustable weight set apparatus as set forth in claim 1 wherein the width of the second locking element is at least about two-thirds of the width of the first locking element.

6. A weight plate for use in an adjustable weight set, the weight set including a handle, the weight plate comprising:

a weight plate member having a plate surface;

a centrally disposed hole in the weight plate member configured to receive the handle for retaining the weight plate to the weight set; and a locking mechanism on the weight plate member for securing the weight plate to another weight plate of the weight set, the locking mechanism comprising a plurality of spaced apart locking elements each being formed by at least one cut in the weight plate member, at least a portion of each locking element being displaced from the plate surface forming a slot behind the locking element, the slot being configured to receive a locking element on said another weight plate of the weight set to secure the weight plate to said another weight plate, the locking elements being arranged relative to each other and to the centrally disposed hole for securely retaining the weight plate and said another weight plate to each other, the locking elements comprising a first locking element positioned substantially centrally on the weight plate member such that the first locking element includes the centrally disposed hole, and a second locking element disposed below the first locking element;

wherein the weight plate member has a width and the first locking element of the weight plate member has a width that is greater than one-third of the width of the weight plate member; and wherein the second locking element of the weight plate member has a width that is greater than one-half of the width of the first locking element of the weight plate member.

7. The weight plate as set forth in claim 6 wherein the weight plate member includes a lower portion and an upper portion oriented at an angle with respect to the lower portion, each of the first and second locking elements being located on the lower portion of the weight plate member.

8. The weight plate as set forth in claim 7 wherein the upper portion of the weight plate member and each of the first and second locking elements is oriented at about the same angle with respect to the lower portion of the weight plate member.

9. The weight plate as set forth in claim 7 wherein the upper portion of the weight plate member is free of a cut forming a locking element displaced from the upper portion of the weight plate member.

10. The weight plate as set forth in claim 6 wherein the width of the second locking element is at least about two-thirds of the width of the first locking element.

* * * * *